US007520506B2

(12) United States Patent
Dax et al.

(10) Patent No.: US 7,520,506 B2
(45) Date of Patent: Apr. 21, 2009

(54) LAYER PRESS FOR COMPRESSING STACKS OF SHEET-LIKE ARTICLES

(75) Inventors: Roman Dax, Bäretswil (CH); Marcel Tremp, Winterthur (CH)

(73) Assignee: Ferag AG, Hinwil (CH)

( * ) Notice: Subject to any disclaimer, the term of this patent is extended or adjusted under 35 U.S.C. 154(b) by 252 days.

(21) Appl. No.: 11/677,919

(22) Filed: Feb. 22, 2007

(65) Prior Publication Data

US 2007/0200287 A1 Aug. 30, 2007

(30) Foreign Application Priority Data

Feb. 27, 2006 (CH) ..... 0304/06

(51) Int. Cl.
*B65H 31/26* (2006.01)

(52) U.S. Cl. ..... 271/220; 100/215

(58) Field of Classification Search ..... 271/207, 271/220; 100/3, 7, 215, 233; 414/790.2
See application file for complete search history.

(56) References Cited

U.S. PATENT DOCUMENTS 3,805,971 A * 4/1974 Behrens et al. ..... 414/789
4,886,265 A 12/1989 Wetter
5,392,708 A * 2/1995 Dorn ..... 100/215
6,142,075 A 11/2000 Koch et al.
6,918,733 B2 * 7/2005 Neuber et al. ..... 414/426
2004/0140607 A1 7/2004 Honegger
2006/0181000 A1 * 8/2006 Nishida et al. ..... 271/176

FOREIGN PATENT DOCUMENTS

DE 10 2005 001130 A1 8/2005
EP 0 309 745 A1 4/1989
EP 1 445 224 A1 8/2004

* cited by examiner

*Primary Examiner*—David H Bollinger
(74) *Attorney, Agent, or Firm*—Alston & Bird LLP

(57) ABSTRACT

A layer press (10) for compressing sheet-like articles (12) arranged in a stack (14). The press has an accommodating chamber (18) for accommodating the sheet-like articles (12) and also a pressing arrangement (34) with a contact pressure lever (42) which can be pivoted about a rotary spindle (44) and on which is arranged a contact pressure body (31) with a contact pressure element (32). In a standby position (BS), the contact pressure lever (42) is pivoted into the accommodating chamber so that the contact pressure element (32) engages the uppermost article in the stack, and for pressing purposes, the spacing between a base (20) of the accommodating chamber (18) and the contact pressure element (32) located in the standby position (BS) is reduced. Since the rotary spindle (44) is arranged at or beneath the height of the standby position (BS), the contact pressure element (32) is moved in the direction of the outer periphery of the accommodating chamber (18) during pressing, so that it sweeps over the uppermost sheet-like article (16) with a smoothing action in the process.

12 Claims, 3 Drawing Sheets

LAYER PRESS FOR COMPRESSING STACKS OF SHEET-LIKE ARTICLES

BACKGROUND OF THE INVENTION

The present invention relates to a layer press for sheet-like articles, in particular for folded printed products located essentially horizontally one above the other in a stack.

The general problem with stacking sheet-like articles, in particular folded printed products, is that the stacks are elevated or arched upwards in each case at outer peripheries, in particular along which folds or mutually opposite open edges of the sheet-like articles are arranged, in relation to the height in the center of the stacks. In order to compress the stacks in their layered formation and, if appropriate, to prevent sheet-like articles from flying away as the stack is rotated, it is possible to use so-called layer presses, which act on the uppermost sheet-like article of the stack using a contact pressure element.

A layer press for a printed product is described, for example, in EP-A-0 309 745. The layer press here is part of an apparatus for stacking printed products and is equipped with a pressing apparatus. It is assigned to a stacking shaft and, together with the latter, is mounted in a rotatable manner on a framework. The stacking shaft is bounded in the downward direction by a raisable stacking table on which the printed products end up located. As soon as a predetermined number of printed products ends up located one above the other, piston rods of the pressing apparatus are extended into the stacking shaft, into the region of the corners of the uppermost printed product. The stacking table is then raised and the printed products are pressed against the piston rods. The piston rods are elements of piston/cylinder subassemblies which are arranged on L-profiles which can be pivoted about an axis of rotation counter to the force of a helical spring. As the stacking table is raised and the printed products are pressed, the piston rods with the L-profiles are defected slightly counter to the force of the helical spring, whereupon a position sensor deactivates any further raising action of the stacking table when a certain position is reached. After this, either the entire stacking apparatus is rotated through 180°, in order to deposit further printed products on the rotated stack, or, following lowering of the stacking table, the piston rods with the piston/cylinder subassemblies are moved out of their operating position into a rest position and the stack is transported away.

An object of the present invention is to provide a layer press for pressing and compacting stacks of sheet-like articles which, while being of as straightforward a design as possible, ensures careful handling during pressing of the articles.

SUMMARY OF THE INVENTION

The layer press according to the invention includes an accommodating chamber for accommodating sheet-like articles which end up resting, individually or in the form of sub-stacks, on a base which bounds the accommodating chamber. The sheet-like articles are typically folded printed products. The accommodating chamber is assigned at least one pressing arrangement, which includes a contact pressure element and a drive. The contact pressure element is mounted such that it can be pivoted about a rotary spindle, and it can be moved, with the aid of the drive, from a rest position outside the accommodating chamber, in which the accommodating chamber can be filled from above without obstruction, with sheet-like articles which are to be stacked, into a standby position within the accommodating chamber. By virtue of a reduction in the spacing between the base and the rotary spindle, the contact pressure element moves into a pressing position, in which the contact pressure element acts on the stack by resting on the uppermost sheet-like article.

By virtue of the rotary spindle being arranged at, or preferably beneath, the level of the standby position of the contact pressure element, in addition to a movement component in which the contact pressure element is deflected upward relative to the rotary spindle, the contact pressure element is also subjected to a movement component in the direction of the outer periphery of the accommodating chamber, and thus in the direction of the outer periphery of the uppermost sheet-like article and/or of the stack. In this case, the contact pressure element sweeps over this uppermost sheet-like article with smoothing action.

The combination of pressing and smoothing functions gives rise to a particularly careful treatment of the sheet-like articles and prevents the upwardly arched sheet-like articles at the top from being bent over as the stack is pressed and/or subjected to contact pressure. In order to perform both functions, the contact pressure element is moved merely by a single drive, which simplifies the design of the layer press and thus reduces the production and maintenance costs thereof.

Particularly preferred embodiments of the apparatus according to the invention are provided with features specified in the dependent claims.

BRIEF DESCRIPTION OF THE DRAWINGS

The invention is explained in detail hereinbelow with reference to an exemplary embodiment illustrated in the drawing, in which, purely schematically.

DETAILED DESCRIPTION OF THE PREFERRED EMBODIMENTS

Figure 1:
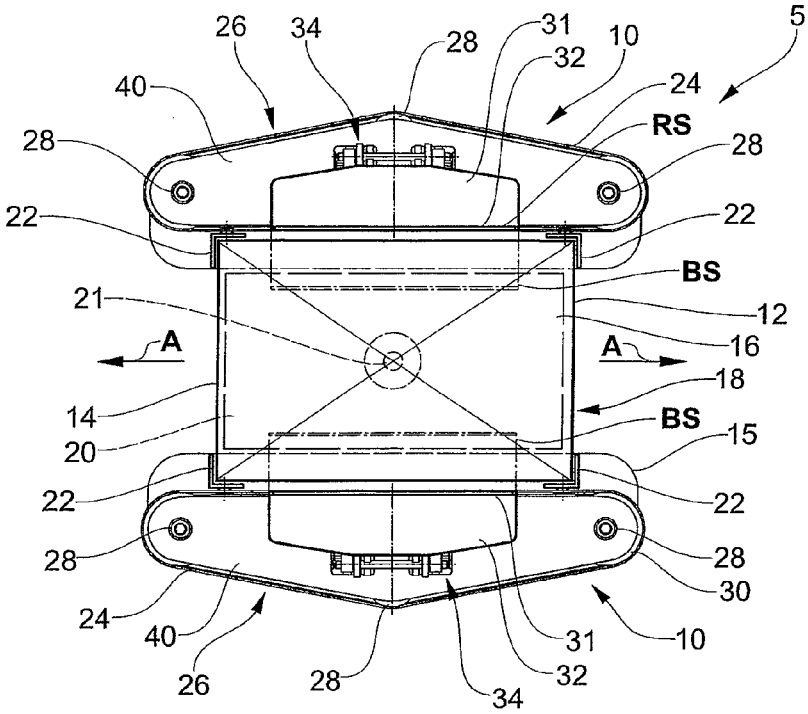
FIG. 1 shows a plan view of a stacking apparatus having two layer presses which are arranged on opposite sides of the accommodating chamber and each have a pressing arrangement, a contact pressure element assigned to the pressing apparatus in each case being illustrated in the rest position by way of a solid line and in a standby position by means of a chain-dotted line.

The stacking apparatus 5 which is shown in FIG. 1 is equipped with two identical layer presses 10 which serve for accommodating sheet-like articles, in particular folded printed products 12, for example newspapers, periodicals, paperboard or cardboard, and for forming these in a stack 14 and for pressing the stack 14. Pressing is used hereinbelow to describe an operation for increasing the layer density in the stack 14, the stack also being maintained in the process.

The layer presses 10 are arranged together on a framework 15 which is mounted on a machine pedestal such that it can be rotated about a vertical axis, part of this framework being shown in FIG. 1. The plan view of FIG. 1 shows just the uppermost printed product 16 of the stack 14, which is formed in an accommodating chamber 18. The accommodating chamber 18 is assigned to both layer presses 10, which are located opposite the long format sides of the printed products 16.

The accommodating chamber 18 is bounded at the bottom by a base 20, which is depicted by dashed lines in FIG. 1 and on which the printed products 12 end up located. The base 20 runs more or less horizontally and can be adjusted in height in relation to the framework 15, and the layer presses 10 arranged thereon, by means of a lifting piston 21 (likewise depicted by dashed lines in FIG. 1), which supports the base 20 in the center. Four angle profiles 22 define the accommodating chamber 18 laterally. The angle profiles are each assigned to one of the four vertical edges of the stack 14 and are spaced apart therefrom with play. The angle profiles 22 ensure that the printed products 12 are positioned at least more or less congruently one above the other as they are fed from above, that the stack 14 is supported at the edges, even if the stacking apparatus 5 is rotated, and that the stack 14 is transported away from the accommodating chamber 18 by an ejecting movement. The ejecting movement here describes a movement by which angle profiles 22 each assigned to a vertical side of the stack 14 are displaced in one of two possible ejecting directions A.

Figure 2:
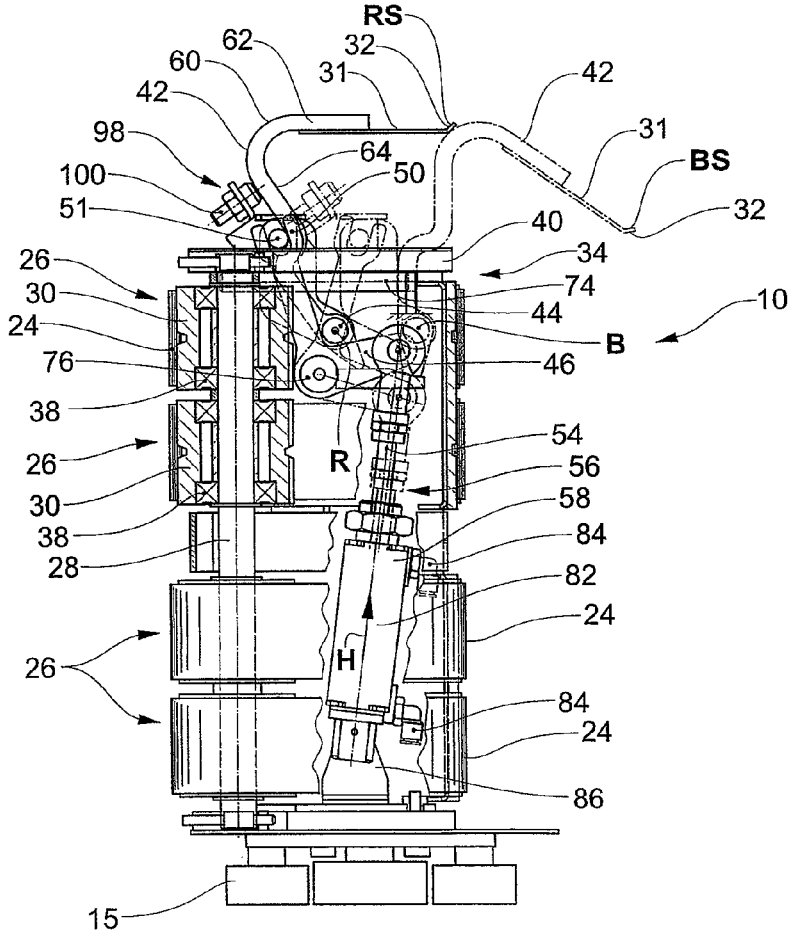
FIG. 2 shows a partially sectioned side view of the layer press of the stacking apparatus shown in FIG. 1, the rest position of the contact pressure element, once again, being illustrated by means of a continuous line and the standby position being illustrated by means of a chain-dotted line.

Each angle profile 22 is fastened on in each case two circulating belts 24, which are shown in FIG. 2. It can be moved independently of a further angle profile 22 which is assigned to the same layer press 10 and is fastened on two further circulating belts 24 assigned to the same layer press 10. In respect of the functioning, the construction and various embodiments of circulating pushing units 26 formed by the abovementioned angle profiles 22 and the circulating belts 24, reference is made to EP-A-1445224 and corresponding U.S. Pub. No. 2004/0140607 A1.

In the case of a stacking apparatus 5 which is shown in FIG. 1, and parts of which are shown in FIG. 2, the circulating pushing units 26 are each arranged, together with their associated layer presses 10, on the longer format sides. The circulating pushing units 26 are retained on vertical spindles 28, oriented at right angles to the base 20, in each case above base surfaces shaped essentially in the form of rounded triangles. Each circulating pushing unit 26 is fastened on three vertical spindles 28 in each case. On at least one vertical spindle 28, each circulating pushing unit 26 is equipped with drive elements, for example electric motors, which can drive the circulating belts 24 independently of one another. The two vertical spindles 28 which remain in each case are equipped with rotatably mounted circulating wheels 30, around which the tension circulating belts 24 are guided.

The stacking apparatus 5 with the layer presses 10 which is described here can easily be adapted to different formats of sheet-like articles or printed products 12 by the dimensions of the accommodating chamber 18 being varied by virtue of changing the spacing, on the one hand between the layer presses 10 with their associated circulating pushing units 26 and, on the other hand, between the angle profiles 22 fastened on the circulating belts 24.

Each of the layer presses 10, as shown in FIG. 1, has planar, essentially rectangular contact pressure bodies 31 above the circulating pushing units 26 and in the center in each case between the two vertical spindles 28 in the vicinity of the stack. In their free end regions directed toward the central region of the accommodating chamber 18 in each case, the contact pressure bodies 31 are equipped with contact pressure elements 32. The contact pressure elements 32 here are formed as contact pressure edges, but, as an alternative, may also be formed, for example, by contact pressure rollers.

The contact pressure elements 32 are illustrated in FIG. 1, on the one hand, in a rest position RS by way of a solid line and, on the other hand, in a standby position BS by means of a chain-dotted line. Where the contact pressure elements 32 in their rest position RS are located outside the accommodating chamber 18, in particular in order not to obstruct a feed of printed products 12 from above, they extend into the accommodating chamber 18 in their standby position BS and can come into abutment here with the uppermost printed product 16.

The contact pressure bodies 31 with their contact pressure elements 32 are assigned to a pressing arrangement 34, which is described in detail hereinbelow.

The construction of a layer press 10 can be gathered from the partially sectioned illustration of FIG. 2. The layer presses 10 are both arranged on a common framework 15 which can be rotated about a vertical axis, and part of which is shown in FIG. 2. From the framework 15, the three vertical spindles 28 rise up above an essentially triangular base surface. In FIG. 2, the vertical spindle 28 which is remote from the accommodating chamber is illustrated in section in the top part, which is directed towards the contact pressure element 32, and is illustrated by dashed lines in the bottom part of the circulating pushing unit 26. For reasons of clarity, the four circulating belts 24, which are arranged in alignment one above the other and can be activated in pairs, have been illustrated without the angle profiles 22 arranged on them. In the case of the top two circulating wheels 24 of the vertical spindle 28 which is remote from the accommodating chamber, these wheels being illustrated in section, it can be seen that they are fastened on the vertical spindle 28 such that they can be rotated by means of circulating-wheel bearings 38.

Fastened at the top end regions of the vertical spindles 28, these end regions being located opposite the framework 15, is a covering panel 40 which, as can be gathered from FIG. 1, likewise has its basic shape in the form of a rounded triangle. It prevents dirt and other objects from passing through and protects against accidental or undesirable intervention in the layer press 10. The covering panel 40 is provided with an aperture through which two contact pressure levers 42, of which just one contact pressure lever 42 can be seen in FIG. 2, on account of the side view, project beyond the covering panel 40. At the free end regions of the contact pressure levers 42, the contact pressure body 31 is fastened to the contact pressure element 32. It is also the case in FIG. 2, as in FIG. 1, that the rest position RS of the contact pressure element 32, and of the contact pressure levers 42 bearing the same, is illustrated by way of a solid line; the standby position BS is indicated by a chain-dotted line.

In addition to the contact pressure levers 42 with the contact pressure body 31 fastened thereon, the partially sectioned regions of FIG. 2 show further elements belonging to the pressing arrangement 34, for example a rotary spindle 44, on which the contact pressure levers 42 are mounted in a pivotable manner, a pivoting lever 46, of which the first lever arm 48 is designed as a fork 50, which engages part of the way around a connecting rod 51, and of which the second lever arm 52 is articulated on the piston 54 of a piston/cylinder subassembly 58 formed as the drive 56. The individual elements of the pressing arrangement 34 are described in detail hereinbelow with reference to FIGS. 3 and 4.

Figure 3:
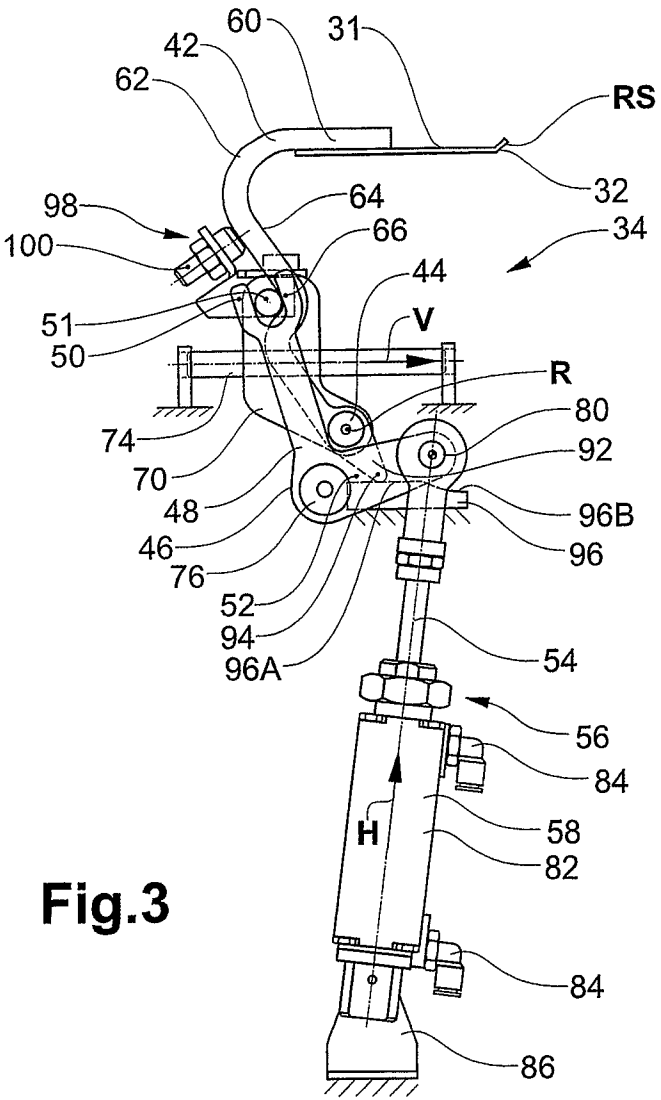
FIG. 3 shows a side view of the pressing arrangement of the layer press shown in FIG. 2, with the contact pressure element arranged on a contact pressure lever and with a drive in the form of a piston/cylinder subassembly.

As is illustrated in FIG. 3, a first contact pressure lever arm 60 of the contact pressure lever 42 is of essentially hook-like form. An outer leg 62, which constitutes the free, contact pressure-element end region of the first contact pressure lever arm 60, forms an angle of approximately 60° with an inner leg 64, which constitutes the opposite, rotary spindle end region of the first contact pressure lever arm 60. The inner leg 64 itself is S-shaped and has a connecting rod mount 66 in the center along its longitudinal axis. This connecting rod mount 66 has a connecting rod 51, which is oriented at right angles to the inner leg 64 and parallel to the rotary spindle 44, engaging behind it, and supporting it, at the rear, on the side which is directed away from the accommodating chamber 18.

Figure 4:
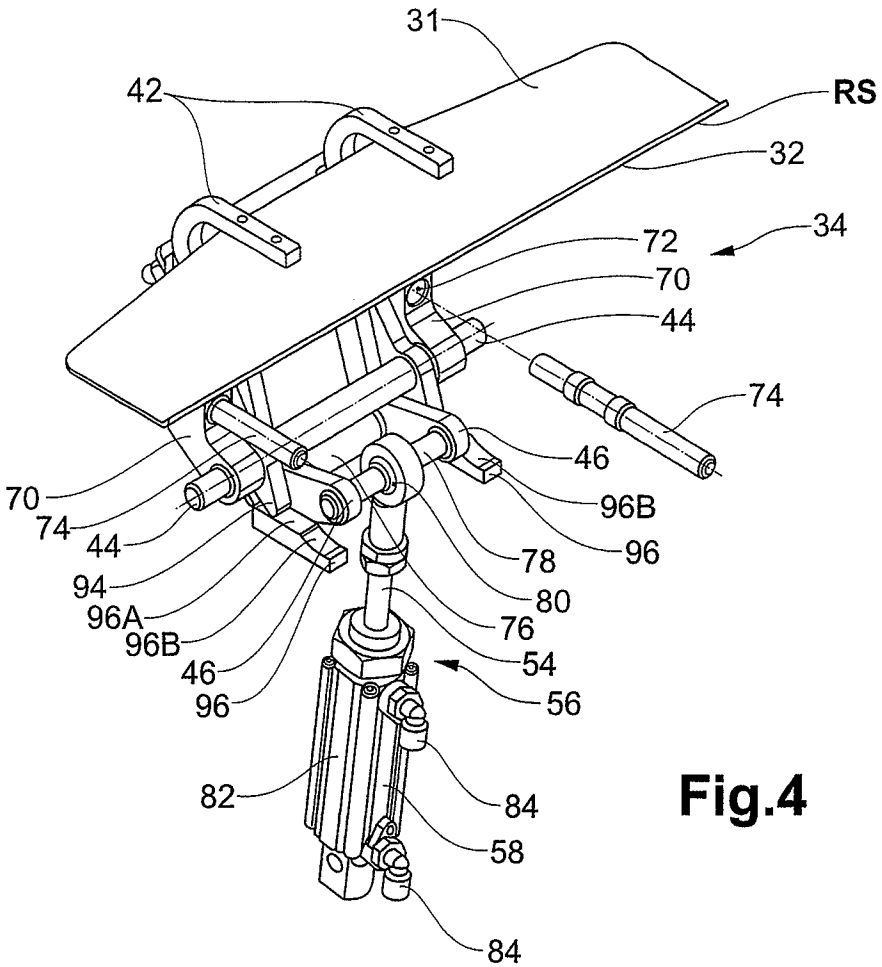
FIG. 4 shows a perspective view of the pressing arrangement shown in FIG. 3, the contact pressure element being located in the rest position and a guide bar being illustrated in a state in which it has been pulled out of a guide aperture in a bearing body.

The rotary spindle 44 and also the connecting rod 51 are retained in an angular bearing body 70. As can be gathered from the perspective illustration of FIG. 4, there are two bearing bodies 70, which retain the connecting rod 51 in two opposite end regions in each case. The bearing bodies 70 each have a guide aperture 72, through which engages a respective guide bar 74 for positively guiding the bearing bodies 70 along a displacement direction V. In the illustration of FIG. 4, a guide bar 74 has been pulled out of the associated guide aperture 72. The two guide bars 74 of a respective pressing arrangement 34, as are shown in FIG. 3, are supported in a stationary manner on a merely schematically indicated inner framework of the respective layer press 10. The guide bars 74 are preferably provided with lubricants in order to reduce the sliding friction between them and the bearing bodies 70, so that the bearing bodies 70 can smoothly be displaced forward and back along the displacement direction V.

As has already been mentioned, the connecting rod 51 is gripped, in its two outer end regions, by forks 50 formed on the pivoting levers 46. The two pivoting levers 46 of the pressing arrangement 34 are mounted in a rotatable manner on a pivoting-lever spindle 76 arranged in a stationary manner on the inner framework of the layer press 10. As can be seen, once again, from FIG. 4, the second lever arms 52 of the two pivoting levers 46 are connected to one another via an articulating rod 78. The articulating rod 78 is mounted in a rotatable manner on the piston 54 of the piston/cylinder subassembly 58. It engages through an articulating bearing 80 fitted in the end region of the piston 54.

The piston 54 is mounted such that it can be displaced along a displacement direction H in the cylinder 82. The cylinder 82 is equipped with two connections 84 which connect the cylinder 82 in terms of flow, via hoses and/or conduits, to known pneumatic or hydraulic pressure generators. Depending on the pressure conditions at the connections, the piston 54 is either retracted into the cylinder 82, or extended out of the cylinder 82, along the displacement direction H.

In its end region which located opposite the piston 54, the cylinder 82 is mounted in a rotatable manner on a cylinder mount 86, which is arranged in a stationary state in relation to the inner framework of the layer press 10. On account of this support and of the connection of the piston 54, via the articulating rod 78, to the pivoting lever 46, the entire piston/cylinder subassembly 58 pivots slightly when the piston 54 is extended, and the displacement direction H changes slightly in relation to the vertical spindles 28 in the process. This can be seen in FIG. 2, in which the piston 54 is illustrated in its fully extended position by means of solid lines and in its retracted position by way of dashed lines.

By virtue of the piston 54 being retracted and extended, the pivoting lever 46 is pivoted about its pivot lever spindle 76, which is arranged in a stationary manner on the inner framework of the layer press 10. The forks 50 of the first lever arm 48 move the connecting rod 51 forward and back, the connecting rod having the fork 50 engaging part of the way around it and being positively guided via the bearing bodies 70. As a result, it is also the case that the rotary spindle 44, which is arranged on the bearing body 70, is displaced along the displacement direction V from a rest position R, which is illustrated in FIG. 3, with the piston 54 extended into a standby position B, in which it is closer to the accommodating chamber 18, with the piston 54 retracted.

Since the contact pressure levers 42 are mounted in a rotatable manner on the rotary spindle 44, a displacement of the piston 54 also results in a displacement of the contact pressure levers 42 and the contact pressure element 32, which is connected to these levers via the contact pressure body 31. The rest position RS of the contact pressure element 32 (solid lines in FIGS. 1 and 2) is assigned to the extended piston position and the standby position BS thereof (chain-dotted lines in FIGS. 1 and 2) is assigned to the retracted piston position.

When the rotary spindle 44 is displaced from its rest position R to the standby position B, the contact pressure element 32 with the contact pressure levers 42 does not just execute a linear displacement; rather, it swings down into the standby position BS, with the assistance of inertia, together with the contact pressure levers 42 and the contact pressure body 31 as soon as the rotary spindle 44, in the course of its forward displacement in the direction of the accommodating chamber 18, comes to an abrupt standstill in the standby position B because the piston 54 has reached its retracted end position. In the standby position BS, the contact pressure element 32 can pass into abutment against the uppermost printed product 16 of the stack 14 if the stack 14 and the base 20 have reached a corresponding height.

In order that the uppermost printed product 16 is not damaged when the contact pressure element 32 swings down onto it, and the contact pressure element 32 remains in abutment against the uppermost printed product 16 when the base 20 is raised, the friction between the bearing bodies 70 and the contact pressure levers 42 is set to be greater than a corresponding minimum value. On the other hand, it is also the case that the friction does not exceed a certain maximum value, in order that swing-down action into the standby position BS is ensured and the uppermost printed product 16 is not damaged when the contact pressure element pivots back from the standby position BS into the pressing position PS and sweeps over said uppermost printed product 16 with smoothing action in the process.

Either the friction occurs between the pivotable contact pressure levers 42 and the rotary spindle 44, which is mounted in a rotationally fixed manner in the bearing bodies 70, or, for the case where the contact pressure levers 42 are fastened in a rotationally fixed manner on the rotary spindle 44, the friction acts between the rotary spindle 44 and bearings for the rotary spindle 44 in the bearing bodies 70.

Both in the course of the forward displacement of the rotary spindle 44 to the standby position B and in the course of the return displacement of the rest position R, second contact pressure lever arms 92 of the contact pressure levers 42, these arms being formed as follower cams 94, are positively guided with sliding action along guide means serving as swing-back safeguards 96. The swing-back safeguards 96 are arranged in a stationary manner on the inner framework of the layer press 10 and cause the contact pressure element 32 to be guided back into a pivoted position corresponding to its rest position RS as soon as the follower cams 94 are guided over elevated safeguarding portions 96A. The safeguarding portions 96A of the swing-back safeguards 96 are followed, on the accommodating chamber side, by recess portions 96B which are curved downwards in the direction of the base 20, so that, when the follower cams 94 interact with these recess portions 96B—as is the case when the rotary spindle 44 reaches its standby position B—the contact pressure levers 42 can be pivoted freely and it is made possible for the contact pressure element 32 to swing back into the standby position BS.

The processing arrangement 34 is additionally equipped with a rear stop 98, which is fastened on the connecting rod 51 and/or the bearing bodies 70 and prevents the contact pressure levers 42 from pivoting beyond the rest position RS when the rotary spindle 44, in the course of its return movement in the displacement direction V away from the accommodating chamber 18, comes to an abrupt standstill in the rest position R. The rear stop 98 is equipped with adjustable stop screws 100 which have a screw head covered with an elastic material, for example rubber, in order to damp the stopping action of the contact pressure levers 42.

The function of the layer press 10 is described hereinbelow with reference to FIGS. 5*a*-5*d*. The accommodating chamber 18 of the layer presses 10 contains a stack 14 comprising two sub-stacks of folded printed products 12, the two sub-stacks being rotated through 180° in relation to one another about a longitudinal axis of the lifting piston 21. In this case, the printed products 12 of the bottom sub-stack have their folds oriented toward the layer press 10 illustrated on the right, while the folds of the printed products 12 of the top sub-stack are located one above the other on the left hand side.

Figure 5A:
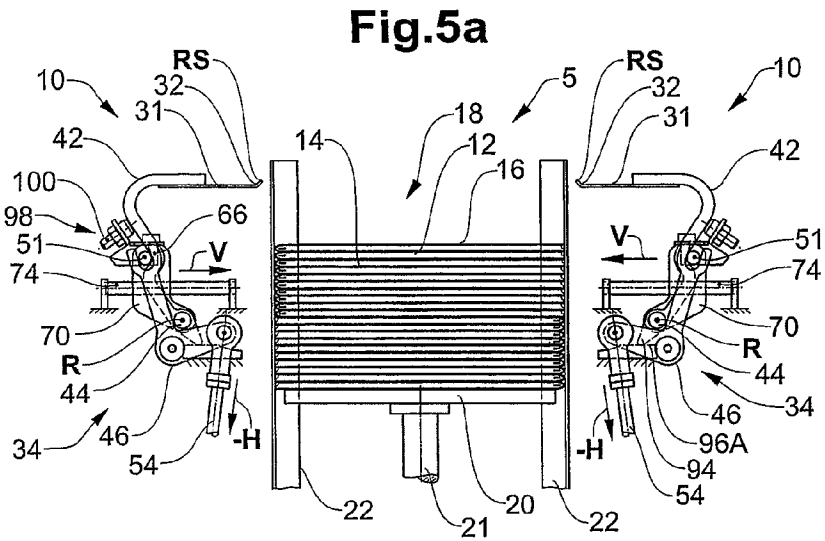
FIGS. 5*a*-5*d* show side views of parts of the bearing press shown in FIG. 1 with pressing arrangements illustrated in FIGS. 3 and 4 and with a stack of folded printed products in the accommodating chamber during a pressing operation, the contact pressure elements being shown in the rest position (FIG. 5*a*), in the standby position (FIG. 5*b*), in a pressing position (FIG. 5*c*) and in a subsequently resumed rest position (FIG. 5*d*).

The layer presses 10 are activated synchronously, so that their contact pressure elements 32 execute identical movements simultaneously. In FIG. 5*a*, the contact pressure elements 32 are located outside the accommodating chamber 18, which is bounded, on the one hand, by the height-adjustable base 20 and, on the other hand, by the angle profiles 22. In the rest position RS shown, the contact pressure elements 32 are oriented at least more or less parallel to the uppermost printed product 16 and to the base 20. The rotary spindles 44 of the pressing arrangements 34 are located in their rest position R. The contact pressure levers 42 butt against the rear stop 98 and, by way of their connecting-rod mount 66, against the connecting rod 51. The pistons 54 are located in their extended position.

Figure 5B:
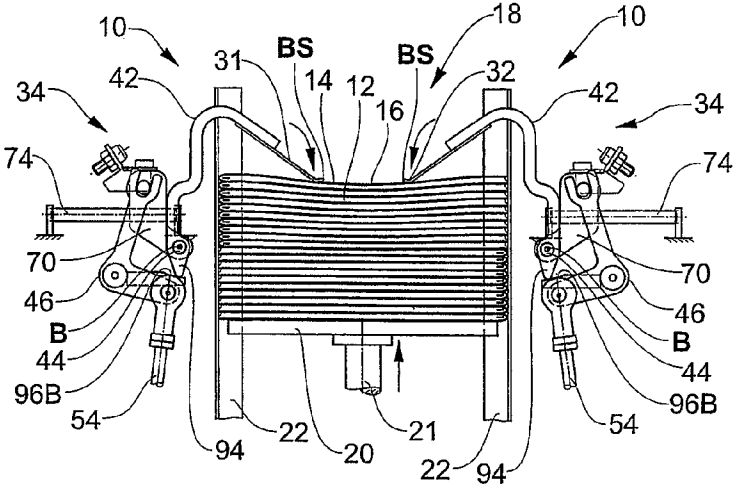

During transfer to the standby position BS, which is shown in FIG. 5*b*, the pistons 54 are retracted, in accordance with the arrows indicated in FIG. 5*a*, and cause the pivoting lever 46 to pivot such that the bearing bodies 70 with the rotary spindles 44 are displaced in displacement direction V toward their standby positions B. During movement in the displacement direction V, the contact pressure elements 32 remain, in the first instance, more or less horizontal. As soon as the pistons 54 have reached their retracted position and the displacement of the rotary spindles 44 in the displacement direction V stops abruptly when the standby position B is reached, the contact pressure elements 32 swing down into their standby position BS—in this case for abutment against the uppermost printed product 16—with the assistance of inertia.

The predetermined friction between the contact pressure levers 42 and the bearing bodies 70 and also the raising of the base 20 cause the printed products 12, in the first instance, to arch upward slightly along their peripheries, whereas they are already compressed in a central region of the accommodating chamber 18. As is indicated by the arrow beneath the base 20 in FIG. 5*b*, the base 20 is raised further in the direction of the contact pressure elements 32.

Figure 5C:
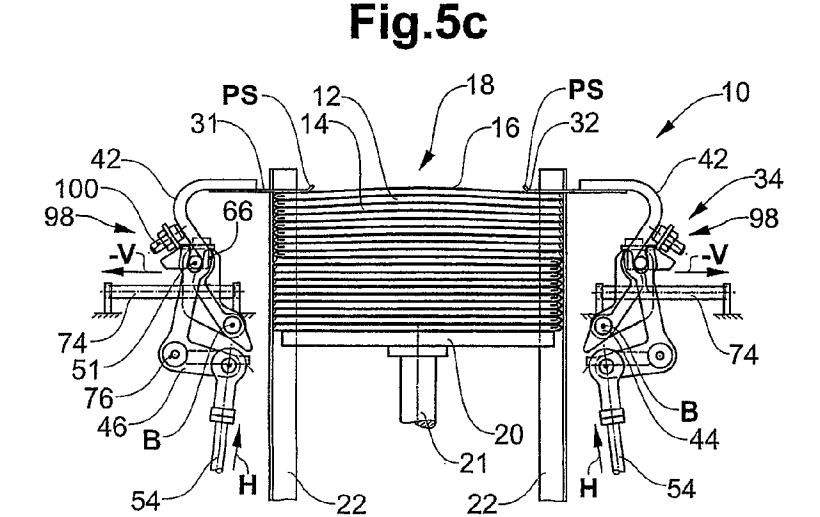

By virtue of the spacing between the contact pressure elements 32 and the base 20 being further reduced, the contact pressure elements 32, as is shown in FIG. 5*c*, are moved into the pressing position PS. The rotary spindle 44 remains, as before, in its standby position B. In the pressing position PS, the contact pressure levers 42 assume a pivoted position similar to that in the rest position RS. During transfer from the standby position BS to the pressing position PS, the contact pressure elements 32 sweep over, and smooth, the uppermost printed product 16 along both sides in the direction of the periphery of the accommodating chamber 18 in order, ultimately, to rest on the peripheries of the uppermost printed product 16 in a state in which they are oriented more or less horizontally and parallel to the base 20.

The contact pressure elements 32 and/or the contact pressure lever 42 are prevented from swinging back further, even in the case of the base 20 being raised further, by the connecting rod 51 butting against the connecting-rod mounts 66 and the contact pressure levers 42 butting against the rear stops 98. As can be seen in FIG. 5*c*, it is now the case in the pressing position PS that in particular the peripheries of the stack 14 which were still previously arched upward in the standby position BS are pressed toward the base 20 and secured. For example a rotation of the stacking apparatus 5 with the two layer presses 10 about the vertical axis can take place in this state, in which case the contact pressure elements 32, exerting pressing action, prevent the printed products 12 from being slung out.

Figure 5D:
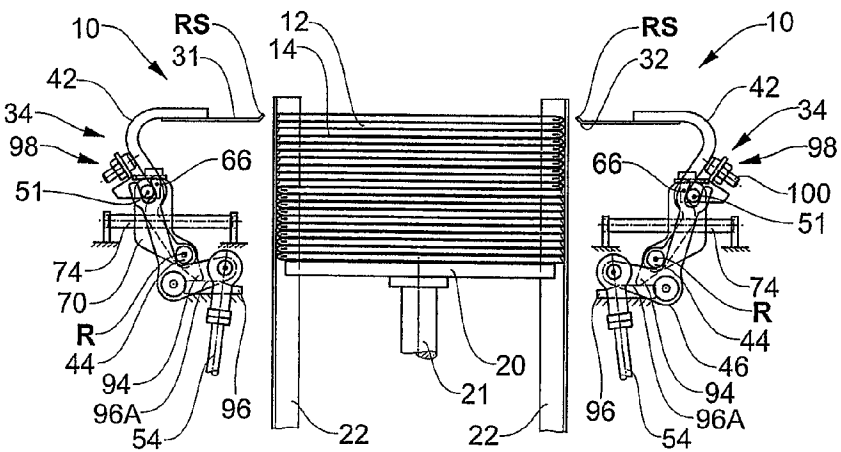

For transfer into the state shown in FIG. 5*d*, in which the stack 14 has been compressed and the pressing arrangements 34 go back into their initial state which is shown in FIG. 5*a*, the base 20 is lowered slightly in the first instance and the pistons 54 are then extended in accordance with the arrows which are shown in FIG. 5*c*. The pivoting levers 46 are thus pivoted about their pivoting-lever spindles 76 and the rotary spindles 44 are consequently displaced back into their rest positions R. In this case, the contact pressure levers 42 with the contact pressure elements 32 remain in their pivoted position similar to the rest position RS, since the follower cams 94 are positively guided over the elevated safeguarding portions 96A of the swing-back safeguards 96.

With the base 20 completely lowered, the compressed stack 14 can then be transported away out of the accommodating chamber 18 in one of the ejecting directions A. It is also possible if appropriate, in the case of a base 20 only having been partially lowered, for further printed products 12 to be positioned on the already compressed stack 14. It is then possible, for example, for the phases shown in FIGS. 5*a* to 5*d* to be repeated and for the then enlarged stack 14 to be compressed.

As an alternative to the embodiment described, it is, of course, possible for the accommodating chamber 18 to be assigned just one layer press 10 or often more than two layer presses 10 to be arranged around the accommodating chamber 18. It should also be mentioned that the contact pressure element 32 can be adapted both in terms of dimensions and shape to the sheet-like articles which are to be pressed. The drive 56 may possibly be formed by an electric motor with an eccentric element. Instead of the base 20 being raised, it is also possible for the pressing apparatus 34, or just the contact pressure levers 42, to be displaced in the direction of the base 20. In addition to the contact pressure element 32 being swung down with the assistance of inertia, and thus passively, it is also possible for this swing-down action to take place actively by means of a further drive.

That which is claimed:

1. A layer press for compressing sheet-like articles located essentially horizontally one above the other in a stack, comprising an accommodating chamber (18) for accommodating a stack of the sheet-like articles, the accommodating chamber being bounded at the bottom by a base (20) on which the sheet-like articles are located, at least one pressing arrangement (34) which includes a contact pressure element (32) which can be pivoted about a rotary spindle (44) arranged outside the accommodating chamber (18), and a drive (56) configured to move the contact pressure element (32) from a rest position (RS) outside the accommodating chamber (18) into a standby position (BS) within the accommodating chamber (18), wherein the contact pressure element (32) can be moved into a pressing position (PS) by a reduction in the spacing between the base (20) and the rotary spindle (44) with the contact pressure element (32) resting on the uppermost sheet-like article (16), and wherein the contact pressure element (32) is arranged on a contact pressure lever (42), and the contact pressure lever (42) can be moved with pivoting action about the rotary spindle (44), which is arranged between the height of the base (20) and the height of the standby position (BS), such that, during movement from the standby position (PS), the contact pressure element (32) is subjected to a movement component in the direction of a periphery of the accommodating chamber (18) and, in the process, sweeps over the uppermost sheet-like article with a smoothing action.

2. The layer press as claimed in claim 1, wherein a forward movement of the contact pressure element (32) from the rest position (RS) into the standby position (BS) and a return movement of the contact pressure element (32) from the pressing position (PS) into the rest position (RS) are brought about by the rotary spindle (44) being moved forwards and back, along a displacement direction (V) between a rest position (R) in which it is remote from the accommodating chamber, and a standby position (B), in which it is in the vicinity of the accommodating chamber.

3. The layer press as claimed in claim 2, wherein the contact pressure lever (42) is mounted on the rotary spindle (44), which is oriented essentially at right angles to the displacement direction (V), and, together with the contact pressure element (32), which is arranged on its first contact pressure lever arm (60), swings down in the direction of the standby position (BS) with the assistance of inertia, as soon as the rotary spindle (44), in the course of its forward displacement, comes to a standstill in its standby position (B).

4. The layer press as claimed in claim 3, wherein the rotary spindle (44) is mounted in a bearing body (70), in relation to which the contact pressure lever (42) can be pivoted with frictional braking, and wherein the bearing body (70) is guided in the manner of a carriage along the displacement direction (V).

5. The layer press as claimed in claim 4, wherein the bearing body (70) has arranged on it a connecting rod (51) which is oriented parallel to the rotary spindle (44), the rotary spindle (44) is engaged around by a fork (50) formed on a first lever arm (48) of a pivoting lever (46), the connecting rod (51) displaces the bearing body (70) with the rotary spindle (44) forward and back by means of the drive (56).

6. The layer press as claimed in claim 5, wherein, on the contact pressure element side, the pressure lever arm (60) is curved in a hook-like manner and, opposite this, it has a second contact pressure lever arm (92) in the form of a follower cam (94), in which case the follower cam (94), during the return displacement of the rotary spindle (44), is positively guided with sliding action by a guide means acting as a swing-back safeguard (96) and causes the contact pressure element (32) to be guided back into its rest position (RS) when the rotary spindle (44) reaches its rest position (R) following the return displacement.

7. The layer press as claimed in claim 6, wherein the pressing arrangement (34) has a rear stop (98) which interacts with the contact pressure lever (42) such that the contact pressure element (32) is prevented from swinging back beyond the rest position (RS).

8. The layer press as claimed in claim 7, wherein the contact pressure element (32) is designed as a contact pressure edge in a free end region of a planar, essentially rectangular contact pressure body (31), and wherein, in the pressing position (PS) of the contact pressure element (32), the contact pressure body (31) runs at least generally parallel to the base (20).

9. The layer press as claimed in claim 1 wherein two of said pressing arrangements are arranged on respective opposite sides of the accommodating chamber, with the accommodating chamber and the pressing arrangements being mounted on a framework which is mounted for rotation about a vertical axis, whereby a stack formed in the accommodating chamber may be pressed before it is transported away and/or during rotation of the framework about the vertical axis.

10. A layer press for compressing stacks of sheet-like articles, comprising an accommodating chamber for accommodating a stack of the sheet-like articles which is supported on a base thereof, a pressing arrangement comprising a contact pressure lever having a contact pressure element mounted thereto, means mounting the pressing arrangement adjacent one side of the accommodating chamber a) for movement from a rest position wherein the contact pressure element is located outside the accommodating chamber and oriented generally horizontally and parallel to the printed products in the stack, to a standby position, and wherein the contact pressure element initially moves in a generally horizontal displacement direction into the accommodating chamber above the base and then swings down for abutment against the uppermost sheet-like article in the accommodating chamber, b) for movement from the standby position to a pressing position wherein the contact pressure element is initially pivoted back to its generally horizontal orientation and then sweeps over and smoothes the uppermost printed product, and c) for movement from the pressing position back to the rest position.

11. The layer press as claimed in claim 10 wherein the layer press comprises a second pressing arrangement which structurally corresponds to the first mentioned pressing arrangement, and a second means mounting the second pressing arrangement adjacent a side opposite said one side of said accommodating chamber, and wherein said second mounting means structurally corresponds to the first mentioned mounting means.

12. The layer press as claimed in claim 11 wherein the first mentioned and the second mounting means are interconnected to operate synchronously.

* * * * *